US007143917B2

(12) United States Patent
Lamothe

(10) Patent No.: US 7,143,917 B2
(45) Date of Patent: Dec. 5, 2006

(54) CONFIGURABLE PAPER TRANSPORT

(75) Inventor: Richard P. Lamothe, Burlington, CT (US)

(73) Assignee: Energy Saving Products and Sales Corporation, Burlington, CT (US)

( * ) Notice: Subject to any disclaimer, the term of this patent is extended or adjusted under 35 U.S.C. 154(b) by 425 days.

(21) Appl. No.: 10/295,063

(22) Filed: Nov. 15, 2002

(65) Prior Publication Data

US 2003/0116599 A1 Jun. 26, 2003

Related U.S. Application Data

(63) Continuation-in-part of application No. 09/703,136, filed on Oct. 31, 2000, now abandoned.

(60) Provisional application No. 60/162,670, filed on Nov. 1, 1999.

(51) Int. Cl.
*B65H 20/24* (2006.01)

(52) U.S. Cl. ..... 226/29; 226/28; 226/9; 226/45; 226/111; 242/645.21

(58) Field of Classification Search ..... 242/615.21, 242/615.3; 226/28, 29, 9, 42, 44, 45, 111
See application file for complete search history.

(56) References Cited

U.S. PATENT DOCUMENTS 3,622,095 A * 11/1971 Turner ..... 242/598.3
3,650,448 A * 3/1972 Jarmy ..... 226/45
4,757,930 A * 7/1988 Ditto ..... 226/27
4,805,111 A * 2/1989 Steidel ..... 700/122
4,839,814 A * 6/1989 Steidel ..... 700/122
5,098,507 A * 3/1992 Mao ..... 156/351
5,241,483 A * 8/1993 Porret et al. ..... 700/125
5,816,152 A * 10/1998 Nelgner et al. ..... 101/181
5,829,707 A * 11/1998 Lamothe ..... 242/538.2
5,860,616 A * 1/1999 Lamothe ..... 242/564.1
5,966,218 A * 10/1999 Bokelman et al. ..... 356/429
6,137,967 A 10/2000 Laussermair et al. ..... 399/16
6,575,399 B1 * 6/2003 Lamothe ..... 242/615.21

* cited by examiner

*Primary Examiner*—Kathy Matecki
*Assistant Examiner*—Evan H. Langdon
(74) *Attorney, Agent, or Firm*—McCormick Paulding & Huber LLP

(57) ABSTRACT

A configurable paper transport having a frame having at least one station for securing a non-driven paper web process device. The configurable paper transport defines a paper web path through the non-driven paper web process device, or devices. The configurable paper transport also contains a driver that moves a paper web along the paper web path. In a preferred configuration, the stations and associated non-driven paper web process devices have a universal receptacle permitting any non-driven paper process device, selected from a plurality of non-driven paper process devices, to be located in any station.

11 Claims, 7 Drawing Sheets

CONFIGURABLE PAPER TRANSPORT

RELATED APPLICATIONS

This application is a continuation-in-part of application Ser. No. 09/703,136 (now abandoned) entitled "Paper Web Inspection and Processing Unit" filed on Oct. 31, 2000, the entire disclosure of which is incorporated herein by reference.

This Application claims the benefit of Provisional Application No. 60/162,670 filed Nov. 1, 1999.

FIELD OF THE INVENTION

The present invention generally relates to an apparatus for processing of a paper web, and more specifically is directed to a configurable paper transport.

BACKGROUND OF THE INVENTION

In a process referred to as paper web finishing, a paper web is converted into a product. Paper web finishing can vary from one product to another. For example, some products may be printed and folded and others may simply be printed. While some products are manufactured in quantities that justify a dedicated assembly line, many products are not. As a result, the assembly line associated with a particular paper web-finishing requirement must be configured when needed.

Traditionally, the assembly line for paper web finishing has been characterized by relatively inflexible assembly line design. When a product was ordered, the processing requirements and the associated process equipment would be identified and a fixed assembly line would be designed and arranged.

A significant challenge in creating an assembly line from these disparate pieces of process equipment is assuring that the speed of the paper web through any given piece of process equipment is the speed required for that process. As a result, the assembly line had to include storage mechanisms to assure that the paper web could be processed continuously. The relatively inflexible design and the integration difficulties of the process equipment made paper web finishing expensive.

In order to reduce the costs associated with assembly line setup, individual process modules were developed. These individual process modules are standalone units performing a dedicated process. The individual modules are on wheels and can be rolled into position and held in position to create an assembly line. The use of positional individual modules increased productivity and thus lowered cost. Each module, however, is by design a standalone machine. As a result, each is optimized for its process and each has a drive system for moving the paper web through the module designed in isolation from the drive systems of other individual process modules. Thus when the modules were configured into an assembly line, differing drive speeds still had to be considered.

Eventually, the drive units of each process module were integrated. In essence, a master drive was created, mechanically or electrically, and the individual drive units were considered slaves to the master drive unit. This however, added considerable control complexity to the assembly line.

Based on the foregoing, it is the general object of the present invention to overcome or improve upon the problems and drawbacks of the prior art.

SUMMARY OF THE INVENTION

The invention is a configurable paper transport. The configurable paper transport has a frame with a paper web path through the frame. A driver on the frame engages a paper web such that the paper web is moved alone the paper web path. The frame defines at least one station, each station being designed to removably secure a non-driven paper web process device, selected from a plurality of non-driven paper process devices, to the frame. When in operation, positioned in least one station is a non-driven paper web process device.

Preferably, the station is a universal station and the non-driven paper web process device is a universal device, such that any non-driven paper web process device can be used in any station. The frame can have any number of stations. Depending upon the number of stations, the stations can be positioned one to the other in numerous configurations. For example, the stations might be linear, orthogonal, or both. The stations might be all in the same plane or stacked. These multiple configurations make it possible to establish paper web paths that are liner or turn. In certain configurations, the turns may even permit a paper web path to enter and exit from the same side of the frame, or a paper web path that splits within the frame.

The frame provides a structure capable of rapid and cost effective reconfiguration, thereby eliminating securing requirements associated with individual modules. The reconfiguration is also simplified, as the drive aspects associated with the movement of the paper web are integral to the frame and not the individual pieces of process equipment.

DETAILED DESCRIPTION OF PREFERRED EMBODIMENTS

Figure 1:
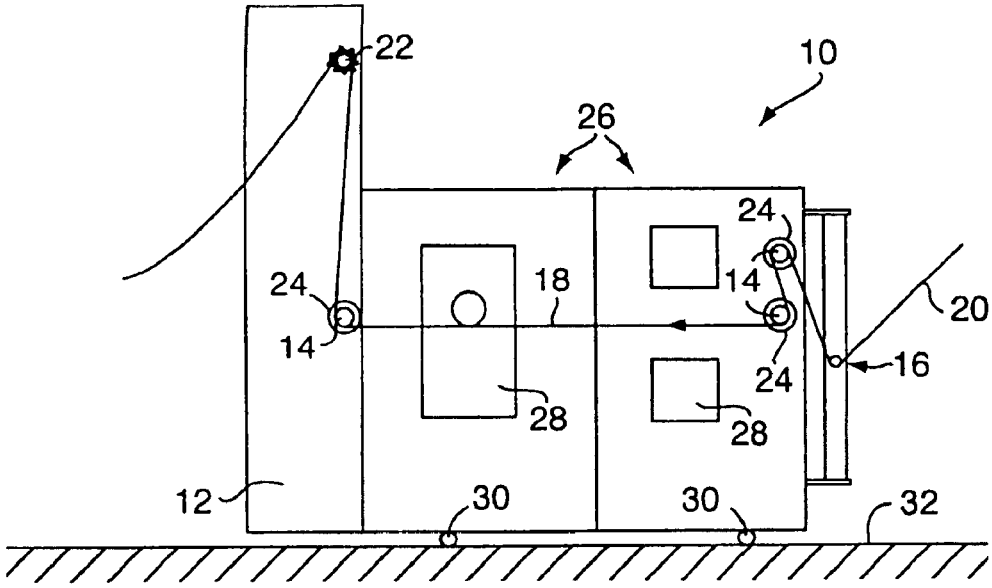
FIG. 1 is a side view of configurable paper transport having non-driven paper web process devices positioned therein.
Figure 2:
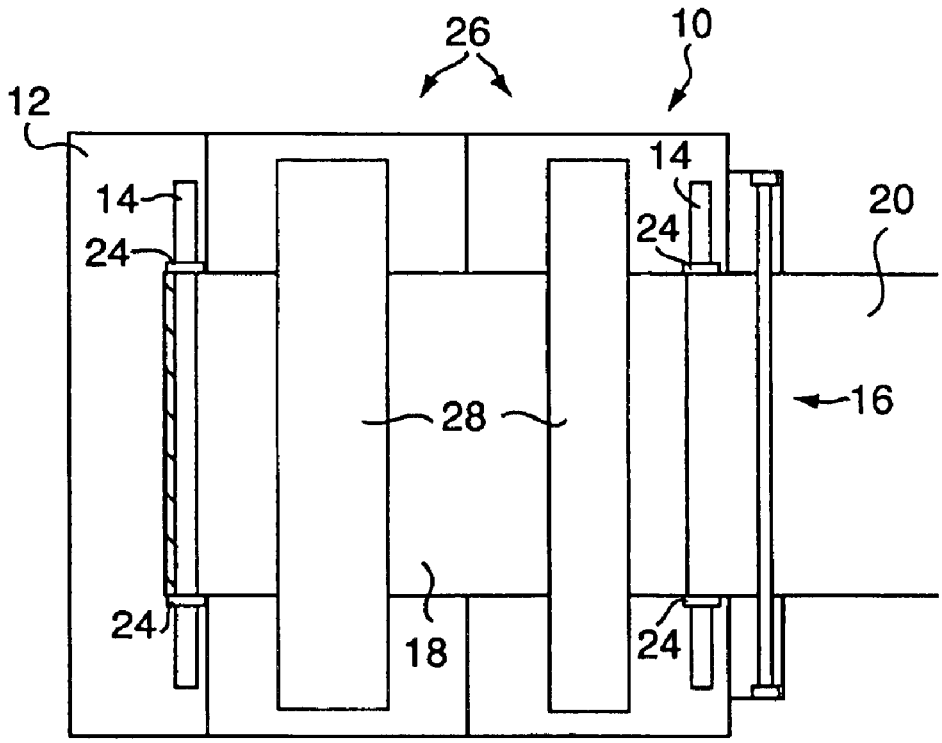
FIG. 2 is top view of the configurable paper transport depicted in FIG. 1.

As shown in FIGS. 1 and 2, the configurable paper transport, generally referred to by the reference number 10, includes a frame 12 having coupled thereto a plurality of rollers 14 and an IPU input loop 16 that define a paper web path 18 which is followed by a paper web 20. Attached to the frame 12 is a driver 22, which may be reversible, that engages the paper web 20 causing the paper web to travel through the frame 12.

Guide wheels 24 also define the paper web path 18. The guide wheels 24, which are mounted on a roller 14, provide lateral confinement of the paper web 20. It is, however, understood that the guide wheels 24 do not necessarily have to be mounted on a roller 14.

The frame 12 contains two stations 26. Each station 26 is configured to removably secure a non-driven paper web device 28, such as a printer or an inspection unit. For maximum flexibility and to minimize setup time, it is preferred that all stations 26 and non-driven paper web devices 28 have a universal receptacle, which permits one of a plurality of non-driven paper web devices to be secured within any station.

Each non-driven paper web device 28 is a non-driven device and can be of any type including but not limited to an inspector, a printer, an encoder, a slitter blade, a perforator, an image thermal transferor, a label applicator, a card affixer, a hole puncher, a die cutter, an adhesive applicator, a web conditioner, a dryer, a paper web turner, or turner. It is an important aspect of the invention that the non-driven paper web process device 28 be non-driven. Non-driven as used herein means that the non-driven paper web process device 28 does not propel the paper web 20 through the frame 12. As each non-driven paper web process device 28 is non-driven, there is no need to link and control the drive mechanisms of various paper web process devices.

For ease of movement, the frame 12 has attached thereto roller wheels 30 that permit the configurable paper transport 10 to be easily relocated on a shop floor 32. It is a desired feature of the configurable paper transport 10 that it can be easy relocated on a shop floor 32 to quickly configure or reconfigure an assembly line. For example, it may be necessary to position the configurable paper transport 10 proximate another configurable paper transport, or another process device or devices (not shown), such as a printer, that is/are simply too large to be incorporated into a station 26. It may also be desirable to co-locate the configurable paper transport 10 with for example the paper web 20 that is on a pallet.

Figure 3A:
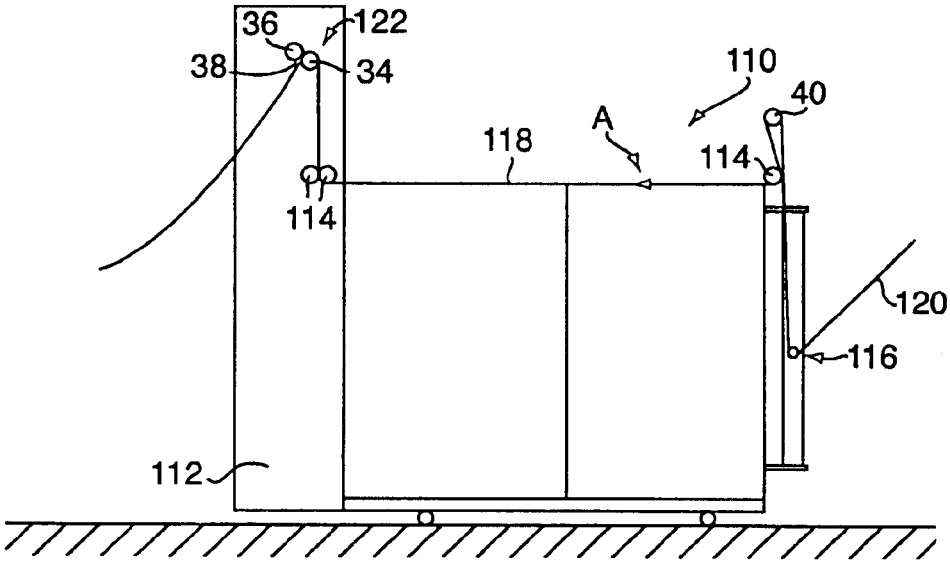
FIGS. 3*a–f* is a side view of several configurable paper transports.

FIGS. 3*a–f* depicts multiple potential paper web paths, these paths are merely exemplary, thus the invention should not be considered limited to the paper web paths disclosed. As many features of the frames depicted in FIGS. 3*a–f* are similar to the previously discussed frame, similar elements will be given the same reference number preceded by the number 1. In FIG. 3*a*, the paper web 120 is pulled along the paper web path 118, in a direction indicated by the arrow labeled A, by a driver 122 that includes a drive roller 34 and a driven roller 36 that create a nip 38 through which the paper web 120 is pulled. The drive roller 34 may be rotated by any suitable means such as a belt around the axis thereof (not shown). Tension is induced into the paper web 120 by a brake roller 40. Positioned between the brake roller 40 and the driver 122 are additional rollers 114 that position the paper web 120 for passage through installed non-driven paper web process devices (not shown).

Figure 3B:
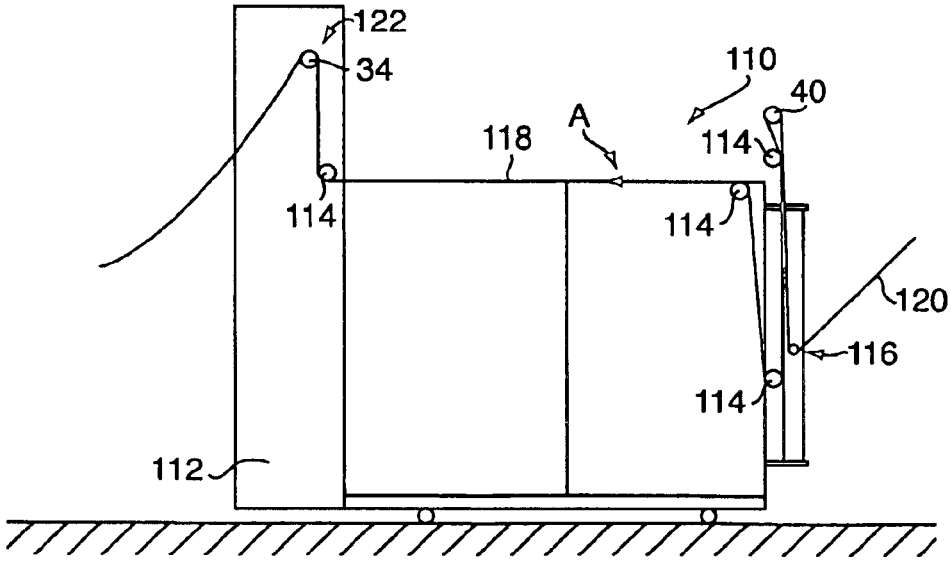
Figure 3C:
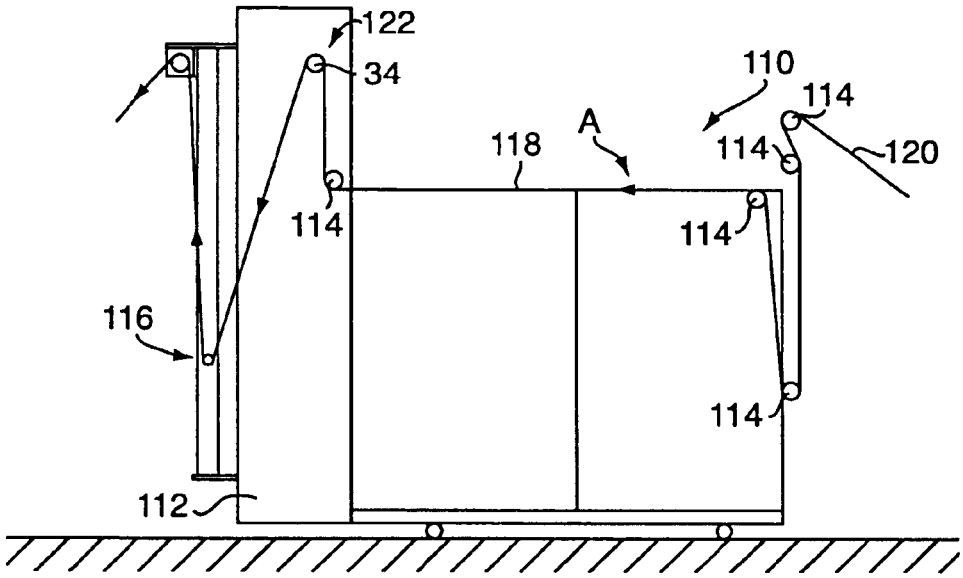

As shown in FIG. 3*b*, the driver 122 can be only the driven roller 34. This type of driven roller 34 is particularly suited to a sprocket that engages complementary holes in the paper web 120. Also illustrated are different positions for rollers 114 that define the paper web path 118. FIG. 3*c* is yet another paper web path 118 configuration.

Figure 3D:
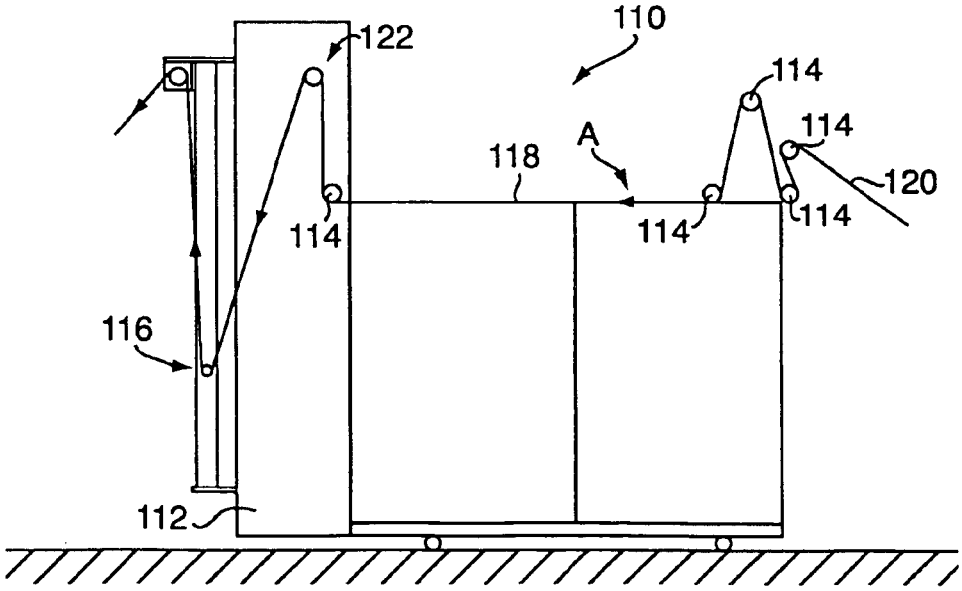
Figure 3E:
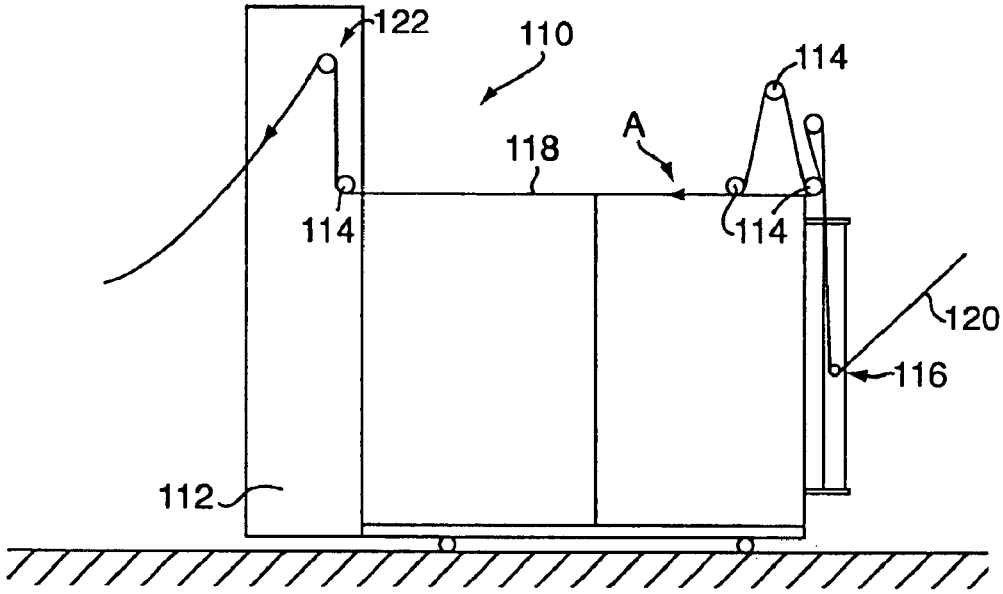
Figure 3F:
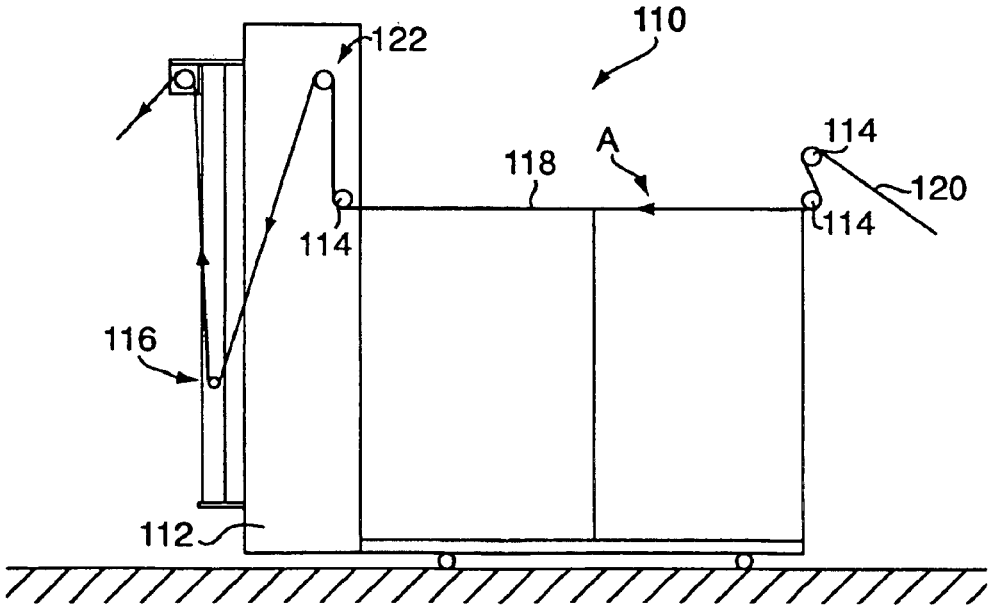

FIG. 3*d* depicts yet another paper web path 118. This paper web path 118 is different from the previous as the IPU loop 116 is spatially downstream of the driver 122, where downstream is based on movement of the paper web 120 along the paper web path denoted by arrow A. FIGS. 3*e* and 3*f* depict additional paper web paths 118.

Figure 4:
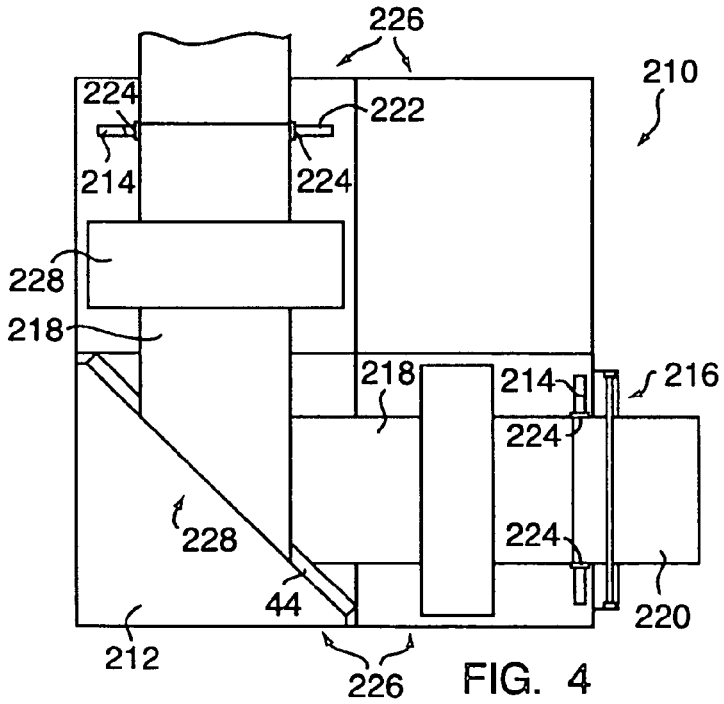
FIG. 4 is a top view of a four station configurable transport having non-driven paper web process devices positioned therein.

FIG. 4 depicts another arrangement of the configurable frame transport. As this transport is similar in many respects to those previously discussed, the same reference number preceded by the number 2 will be used for like elements. The frame 212 has four stations 226 positioned in a square that is planar. As a result, non-driven paper web process devices 228 may be positioned orthogonal one to the other. The paper web 220 is turned within the frame 212 by a non-driven paper web process device 228 containing turning bars 44.

Figure 5:
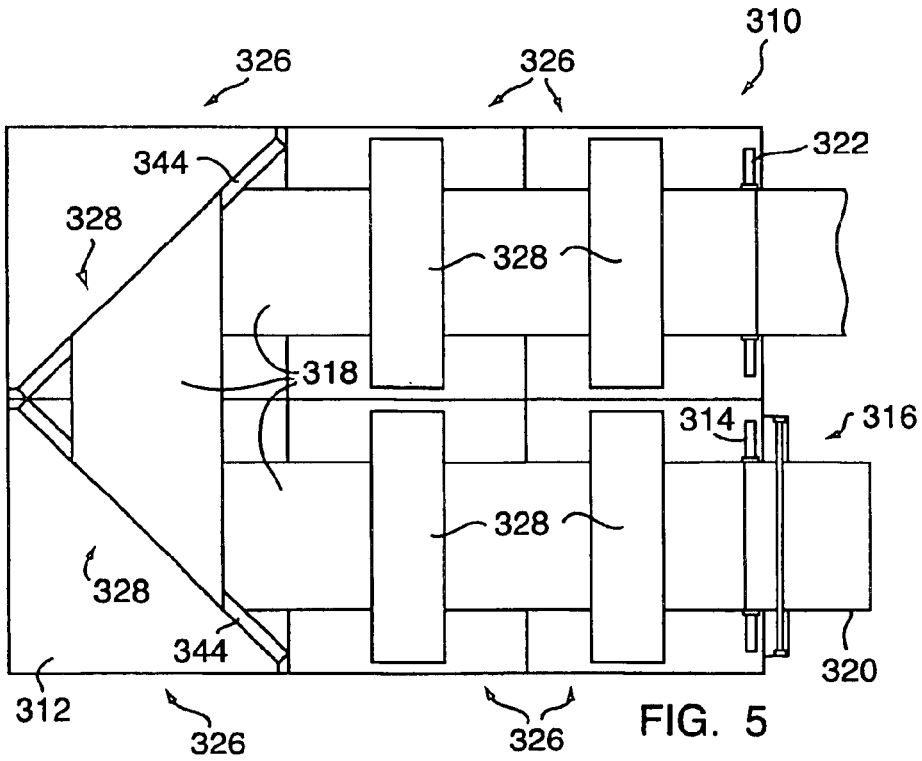
FIG. 5 is a top view of a six station configurable transport having non-driven paper web process devices positioned therein.

FIG. 5 depicts another arrangement of the configurable frame transport. As this transport is similar in many respects to those previously discussed, the same reference number preceded by the number 3 will be used for like elements. The frame 312 has six stations 326 positioned in a rectangle. In this case, the non-driven paper web process devices 328 are positioned such that the paper web 320 enters and exits on the same side of the frame 312. The paper web 320 is turned within the frame 312 by a non-driven paper web process device 228 containing turning bars 344.

Figure 6:
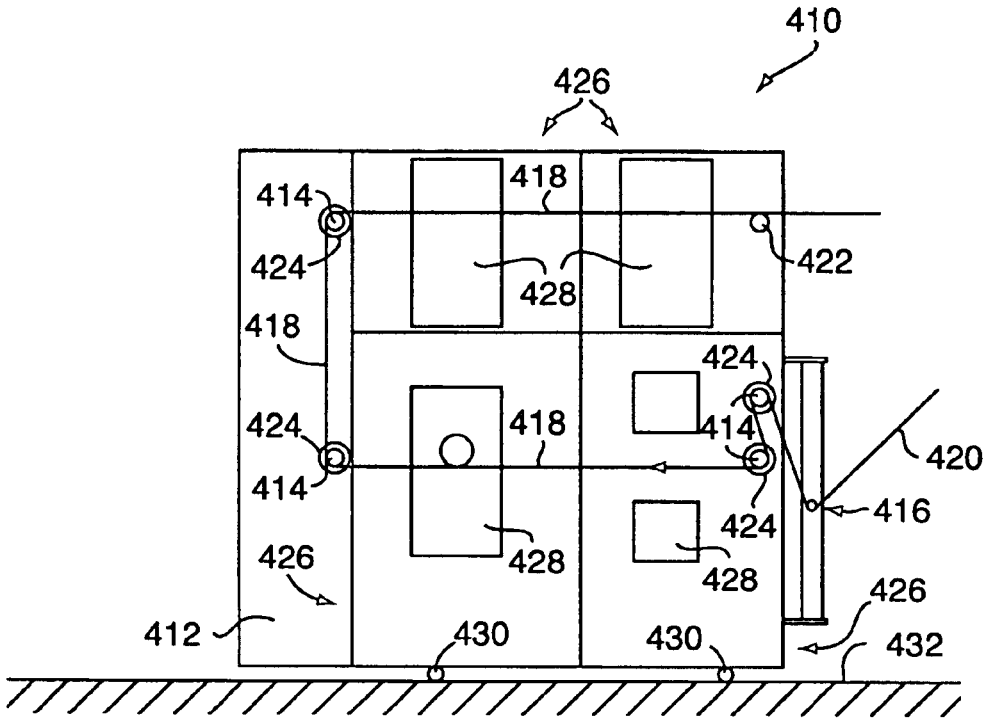
FIG. 6 is a side view of another four station configurable transport having non-driven paper web devices positioned therein.

FIG. 6 depicts another arrangement of the configurable frame transport. As this transport is similar in many respects to those previously discussed, the same reference number preceded by the number 4 will be used for like elements. The frame 412 has four stations 426 that are vertically stacked to create a square. Similarly to the arrangement depicted in FIG. 5, the paper web 420 can both enter and exit the frame 412 from the same side.

While the invention has been described in considerable detail with reference to certain preferred versions thereof, other versions are possible, particularly versions incorporating other roller configurations for defining the paper web path, and controlling and advancing a paper web along the paper web path. In addition, while a single paper web path has been depicted entering, exiting and within the frame, multiple web paths are possible and considered within the scope of the invention. Where multiple web paths are used, multiple drivers might be required. Therefore, the spirit and scope of the invention should not be limited to the description of the preferred versions contained herein.

The following is claimed:

1. A configurable paper transport comprising:

a frame having a paper web path, a driver for positioning and moving a paper web, a tensioner positioned along the paper web path for putting tension on the paper web as it moves along the paper web path and at least one non-driven guide wheel for defining the paper web and preventing lateral movement of the paper web;

two stations attached to said frame, each station having a receptacle therein for removably receiving a non-driven paper web process device, one of said stations having at least one non-driven guide wheel for defining the paper web path and preventing lateral movement of the paper web; and wherein said driver moves the paper web through each of said stations and the non-driven paper web process devices.

2. The configurable transport of claim 1 wherein the driver includes a sprocket having teeth sized to enter holes in the paper web.

3. The configurable paper transport of claim 1 wherein the drive operates in at least two directions.

4. The configurable paper transport of claim 1 wherein the frame has wheels mounted thereto such that the frame can be rolled on a surface.

5. The configurable paper transport of claim 1 wherein the paper web path reverses such that the paper web enters and exits from the same side of the frame.

6. The configurable transport of claim 1 wherein there are at least two stations each having a non-driven paper web process device therein, the non-driven paper web devices being positioned orthogonal one to the other.

7. The configurable paper transport of claim 1 having at least three stations each having a non-driven paper web process device therein wherein two of the non-driven paper web devices are positioned orthogonal one to the other and two non-driven paper web devices are positioned opposite one to the other.

8. The configurable paper transport of claim 1 wherein said non-driven paper web devices are selected from the group consisting of an inspector, printer, encoder, slitter blade, perforator, image thermal transferor, label applicator, card affixer, hole puncher, die cutter, adhesive applicator, dryer, web conditioner, and turning bars.

9. The configurable paper transport of claim 1 wherein said guide wheels are mounted on rollers further defining the paper web path and preventing lateral movement of said web.

10. The configurable paper transport of claim 1 wherein at least one non-driven paper web processing device is secured in a station.

11. The configurable paper transport of claim 1 wherein one station is vertically above another station.

* * * * *